US008910715B2

(12) United States Patent
Linderman et al.

(10) Patent No.: US 8,910,715 B2
(45) Date of Patent: Dec. 16, 2014

(54) OIL WELL CONTROL SYSTEM

(75) Inventors: Charles Earl Linderman, Turnersville, NJ (US); Karl Bachman Dyer, Haddonfield, NJ (US); Ryan Alexander Bandura, Sewell, NJ (US); Eric William Constans, Collingswood, NJ (US); Kandalam Venkata Ramanujachary, Deptford, NJ (US)

(73) Assignee: Rowan University, Glassboro, NJ (US)

( * ) Notice: Subject to any disclaimer, the term of this patent is extended or adjusted under 35 U.S.C. 154(b) by 156 days.

(21) Appl. No.: 13/535,833

(22) Filed: Jun. 28, 2012

(65) Prior Publication Data

US 2013/0000919 A1 Jan. 3, 2013

Related U.S. Application Data

(60) Provisional application No. 61/502,016, filed on Jun. 28, 2011.

(51) Int. Cl.
*E21B 43/01* (2006.01)
*E21B 41/04* (2006.01)

(52) U.S. Cl.
CPC ..... *E21B 43/0122* (2013.01); *E21B 41/04* (2013.01)
USPC ..... 166/363; 166/344; 166/373; 166/376; 166/192

(58) Field of Classification Search
CPC ..... E21B 43/0122
USPC ..... 166/344, 351, 363, 364, 285, 373, 376, 166/386, 179, 192; 277/342; 405/60
See application file for complete search history.

(56) References Cited

U.S. PATENT DOCUMENTS

| | | | | | |
|---|---|---|---|---|---|
| 49,599 | A * | 8/1865 | Sicouret | 277/340 |
| 1,526,411 | A * | 2/1925 | Bell | 166/139 |
| 2,191,783 | A * | 2/1940 | Wells | 166/300 |
| 2,789,004 | A * | 4/1957 | Foster | 294/86.1 |
| 3,069,044 | A * | 12/1962 | Haumann | 220/215 |
| 3,577,737 | A * | 5/1971 | Burleson | 405/227 |
| 3,593,786 | A | 7/1971 | Lewis | |
| 4,151,875 | A | 5/1979 | Sullaway | |
| 4,461,354 | A * | 7/1984 | Buras et al. | 166/343 |
| 4,709,758 | A * | 12/1987 | Preston, Jr. | 166/120 |
| 4,730,835 | A * | 3/1988 | Wilcox et al. | 277/342 |
| 5,150,752 | A * | 9/1992 | Gunst et al. | 166/97.1 |
| 5,361,840 | A * | 11/1994 | Matthews | 166/285 |
| 5,810,082 | A | 9/1998 | Jordan, Jr. | |
| 6,167,963 | B1 | 1/2001 | McMahan et al. | |
| 6,769,491 | B2 | 8/2004 | Zimmerman et al. | |
| 6,923,263 | B2 * | 8/2005 | Eden et al. | 166/288 |
| 7,069,991 | B2 | 7/2006 | Gudmestad et al. | |
| 7,735,549 | B1 | 6/2010 | Nish et al. | |
| 8,485,261 | B2 * | 7/2013 | Botich | 166/363 |

(Continued)

*Primary Examiner* — Matthew Buck
(74) *Attorney, Agent, or Firm* — Dilworth Paxson LLP; Gary D. Colby

(57) ABSTRACT

A system including a combined plug and valve device that may be precisely delivered to and inserted into an uncontrolled undersea oil well. Once positioned in the well, the device is operated in graduated fashion to anchor the plug to the well and gradually stanch the flow of oil from the well.

15 Claims, 10 Drawing Sheets

(56) References Cited

U.S. PATENT DOCUMENTS

| | | | | |
|---|---|---|---|---|
| 2010/0175867 | A1 | 7/2010 | Wright et al. | |
| 2010/0243265 | A1* | 9/2010 | Sherrill et al. | 166/373 |
| 2010/0263857 | A1 | 10/2010 | Frazier | |
| 2011/0303416 | A1* | 12/2011 | Herman, II | 166/350 |
| 2011/0303421 | A1* | 12/2011 | Mickey | 166/386 |
| 2012/0012329 | A1* | 1/2012 | Klapyk et al. | 166/363 |
| 2012/0055573 | A1* | 3/2012 | Adams | 138/89 |
| 2012/0285704 | A1* | 11/2012 | Mothaffar | 166/386 |

* cited by examiner

OIL WELL CONTROL SYSTEM

CROSS REFERENCE TO RELATED APPLICATION

This application claims the benefit of U.S. Provisional Application No. 61/502,016, filed Jun. 28, 2011, the disclosure of which is incorporated herein in its entirety by reference thereto.

FIELD OF THE INVENTION

The present invention relates in general to oil well control systems and, in particular, to systems for managing the flow of crude oil and natural gas discharge from an uncontrolled undersea well.

BACKGROUND OF THE INVENTION

The 2010 crude oil spill in the Gulf of Mexico was a human and environmental disaster of epic proportions. It was the largest oil spill in history. From its beginning on Apr. 20, 2010 with the deadly explosion of the Deepwater Horizon oil drilling rig to Jul. 15, 2010 when the gushing well was effectively capped, the spill resulted in an estimated release of nearly 5 million barrels of crude oil that caused extensive damage to marine and wildlife habitats as well as the Gulf's fishing and tourism industries.

Several futile attempts were made to control the relentless flow of oil from the gushing undersea well which was located some 5000 feet beneath the water surface. These included remote underwater vehicles which failed to close blowout preventer valves on the damaged well head, a 140 ton containment dome, and pumping heavy drilling fluids into the well head. As noted, the well was capped in July and, from early August through September 2010, the well was permanently sealed with cement.

Ancillary to the human, environmental and tourism losses related to the disaster, but nonetheless highly economically significant, was the permanent encasement of crude oil and natural gas that might otherwise have been recovered from the sealed well had it performed as designed throughout its expected service life. To date, it is believed there is no known rapidly deployable system for effectively capping a gushing deep-sea oil well, let alone one which enables the damaged well to remain functional, if desired, after capping.

SUMMARY OF THE INVENTION

The present invention provides a system including methods and apparatus for effectively managing the flow of crude oil and natural gas from an uncontrolled undersea oil well.

The apparatus preferably comprises a combined well plug and valve device disposed within a cage-like housing. The housing desirably carries propulsion and steering means in the form of one or more biaxially rotatable electric propellers or hydraulic propulsion jets that propel and steer the cage and plug and valve device from or near the water's surface to the site of the damaged wellhead. Global positioning technology may aid in positioning of the apparatus to the general vicinity of the damaged wellhead. The apparatus also desirably has at least one on-board camera that provides visual images of the affected site that may be used to assist in precisely positioning and lowering the cage over the center of the damaged wellhead.

The combined well plug and valve device is preferably constructed with a hollow conical head portion and a hollow finned tail portion, both having rearwardly directed jets or nozzles. The head and tail portions are preferably connected to a hollow central tube or pipe via mating threading. The hollow central tube is provided with helical means on and/or in its outer surface. A plurality of threaded plates are screwed onto the helical means. Leading ones of the plates are separated by spacer means formed from consumable material such as thermite which is combustible even in underwater environments. Additionally, each plate includes at least one fluid passageway through which seawater and well fluid is intended to pass. The plates are slightly smaller in diameter than the inside diameter of the well to be plugged and the entire design is easily scalable to fit a well bore, pipe or tube of any diameter in order to control natural gas and crude oil being discharged at any flow rate and pressure.

Prior to launching the apparatus from an oil rig, ship barge or other structure or vessel situated at or beneath the surface of a body of water in which an uncontrolled oil spill is occurring, the fluid passageways of the plates are aligned to form at least one flow channel through which seawater may pass freely as the apparatus travels downwardly through the water toward the uncontrolled well. That is, the fluid passageways of the plates are desirably aligned in order to reduce fluid resistance against the apparatus as it is propelled downwardly through the seawater and into the gushing wellhead.

A hose is releasably attachable to the trailing end or tail portion of the combined plug and valve device. Once the device is in alignment with the well opening, fluid is injected at high pressure into the hose. The pressurized fluid enters the combined plug and valve device and is discharged through the aforesaid jets or nozzles whereby the device is propelled into the well against the pressure of upwardly flowing crude oil and natural gas. Upon insertion of the device to a desired depth within the damaged well, an optional dense stopper such as a ball-like stop may be inserted into the hose whereby it may descend through the hose and into the device until it comes to rest in a socket at the leading end or head portion of the device. With the stop seated in the socket, fluid flow through the leading propulsion jets is obstructed whereby propulsion fluid flow is limited to the set of trailing jets. And, with propulsion flow limited to the rear jets, such flow may be relatively easily sustained at a level sufficient to counteract the flow of gushing crude oil and gas in order to maintain the combined plug and valve device in an essentially static position with respect to the well bore so that the device may be anchored or affixed to the interior of the well.

Upon achieving the desired depth of insertion of the combined plug and valve device into the well, the device may be selectively actuated to gradually and incrementally close the device and to affix it to the affected well bore, tube or pipe and establish a desired degree of upward oil and gas flow through the device. That is, once the combined plug and valve device is positioned in the well as described above, at least some of the plate passageways are brought into misalignment in order to restrict pressurized gas and oil flow through the passageways. To achieve that effect, the consumable material above the lowermost or first leading plate is ignited and the space between that plate and the next plate is vacated. As this is occurring, pressure from the rising oil and gas plume pushes upwardly on the first plate, causing it to rotate and partially obstruct the flow channel established by the previously aligned plate flow passageways. Thereafter, the next consumable spacer layer is ignited and the first and second plates rotate upwardly as a unit until they contact the third plate. This procedure continues until the desired number of spacer layers have been consumed and the flow channels have been partially or completely blocked. As described in greater detail hereinbelow, incremental closing of the combined plug and valve device prevents damage to the device during the process of constricting the flow of gushing crude oil and natural gas while also enabling effective control of the well fluid flow should it be desired to preserve the well as a viable oil and or natural gas production site.

According to a first embodiment, the rotatable and axially movable plates squeeze at least one resilient anchor member that is operable to bulge radially outwardly in order to tightly seal itself against the inner wall of a well bore, tube or pipe upon axial compression exerted by the plates.

According to a second embodiment, at least one of the plates is substantially rigid but has sufficient flexibility such that when compressed between other plates it is caused to flatten and expand into sealed contact with the inner wall of the damaged well bore, tube or pipe.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein:

FIGS. 9*a*-9*j* are elevational and top plan views depicting sequential closure of a combined plug and valve device according to the invention;

DETAILED DESCRIPTION OF THE INVENTION

Figure 1:
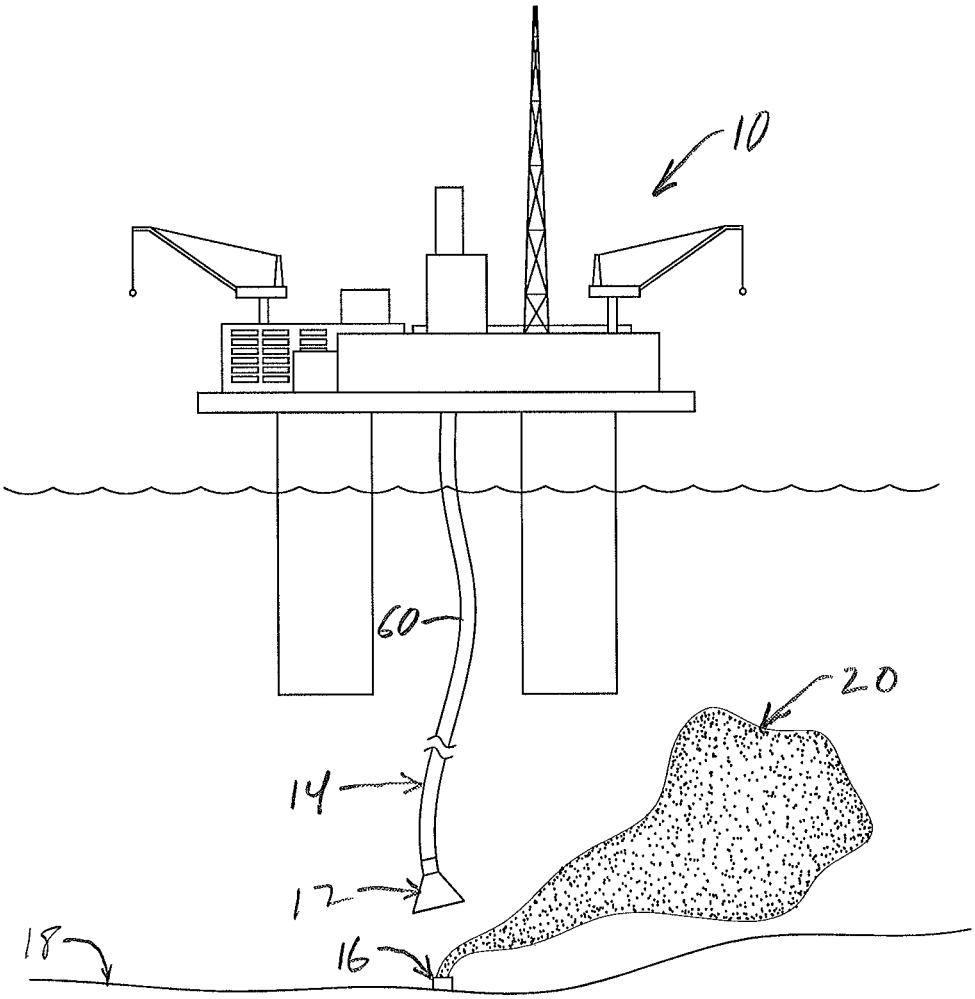
FIG. 1 is a schematic view of an apparatus according to the invention being deployed from an off-shore oil rig.

Referring to the drawings, wherein like or similar references indicate like or similar elements throughout the several views, there is shown in FIG. 1 an offshore oil rig from which an apparatus 12 according the present invention is suspended by a hose and cable arrangement 14. As seen in that figure, apparatus 12 is in the process of being deployed to control a gushing, uncontrolled undersea oil well, the head 16 of which is located at seafloor 18 and from which there is seen a rising plume of crude oil and gas 20.

Figure 2:
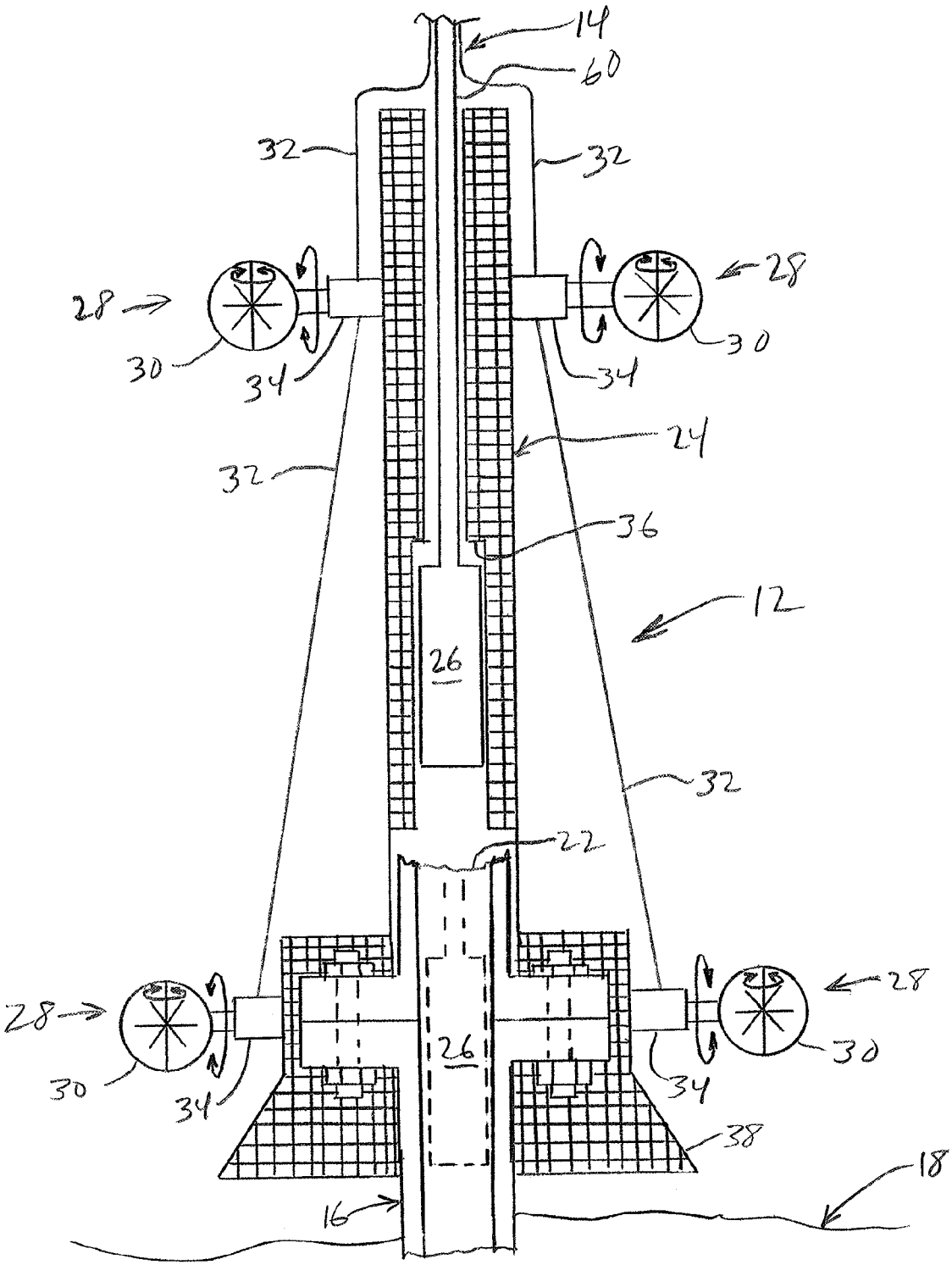
FIG. 2 is an elevational, partial cross-section view of an apparatus according to the invention positioned above a damaged oil wellhead on the seafloor.
Figure 3:
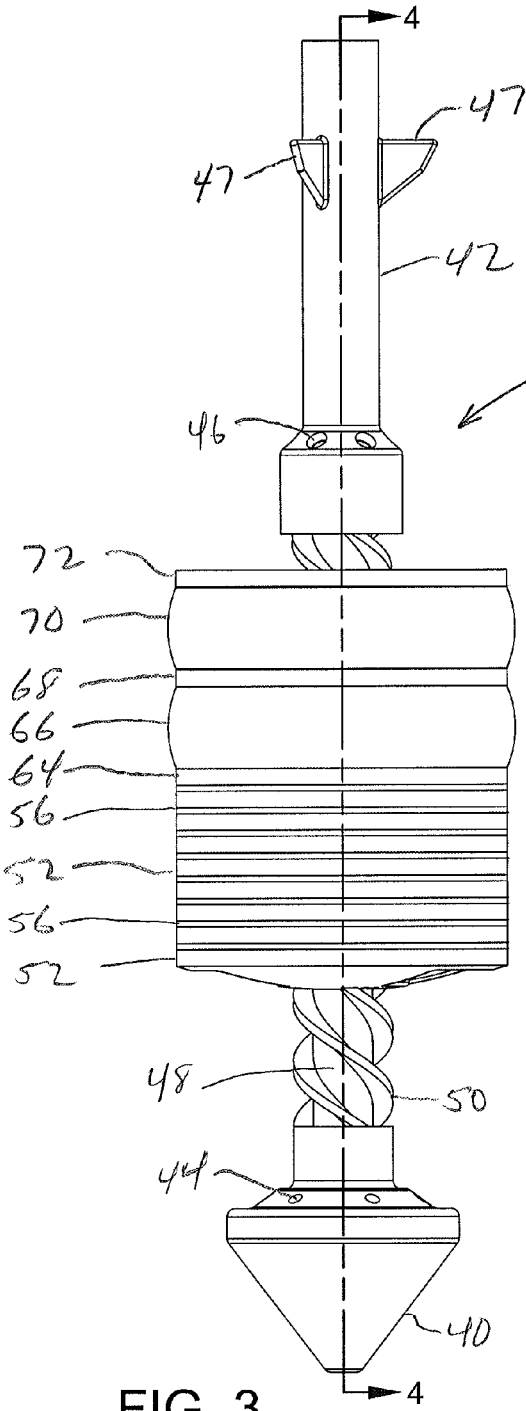
FIG. 3 is an elevational view of a first embodiment of a combined well plug and valve device according to the invention in its pre-anchored state.
Figure 4:
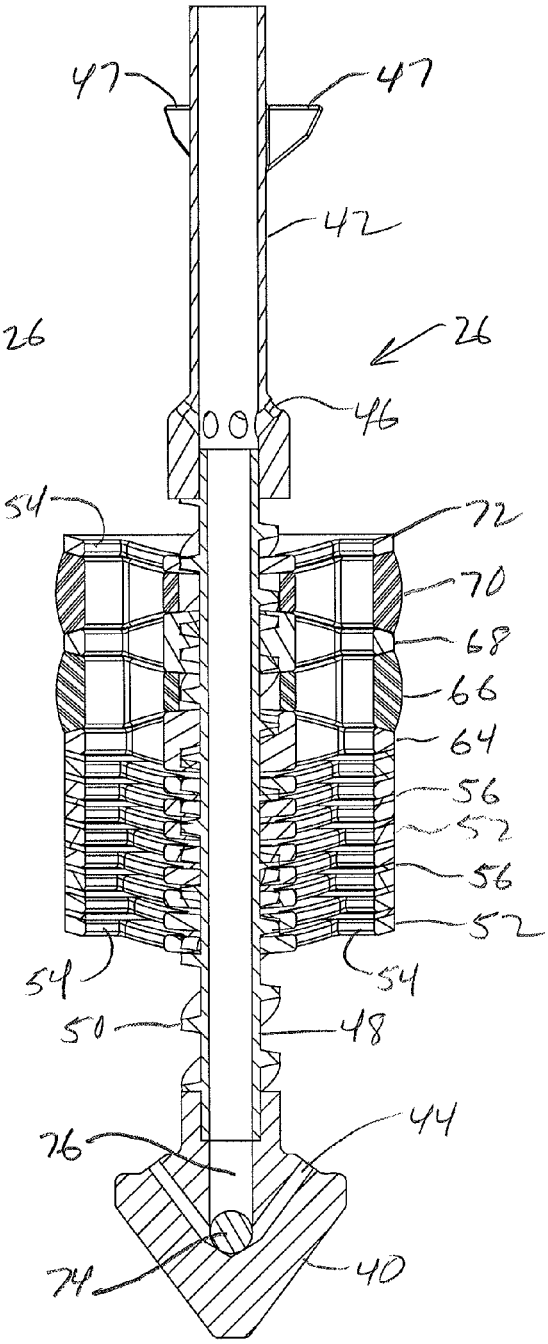
FIG. 4 is an elevational cross-section view of the device taken along line 4-4 of FIG. 3.
Figure 6:
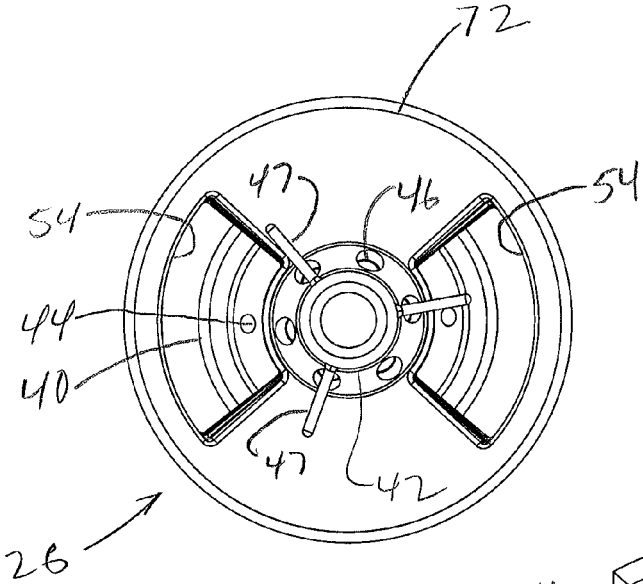
FIG. 6 is a top plan view of the device in its pre-anchored state.

FIG. 2 illustrates on an enlarged scale apparatus 12, hose and cable arrangement 14 and oil wellhead 16. As seen in that figure, wellhead 16 is shown as having a severed top end 22 such as might occur following a catastrophic failure or blowout of the well. Apparatus 12 includes a housing 24 and a combined plug and valve device 26, which is schematically depicted in FIG. 2. Housing 24 is operable to protect and transport device 26 from a point of deployment at or near the water surface, i.e., from an oil rig, ship or other sea vessel, to the damaged well 16 on seafloor 18, which distance may be as much as several hundred to several thousand feet.

Housing 24 is preferably formed from high-strength material such as steel, reinforced plastic or the like that can be fabricated into a three-dimensional shape. While the walls of housing 24 may be fully enclosed, it is preferred that they be constructed as a cage since a cage-like structure renders the housing lighter in weight and therefore more easily manipulated both above and beneath the water surface. In addition, the open spaces of the cage permit fluid flow therethrough. As a consequence, the apparatus passes easily through the seawater as it descends to the damaged wellhead 16 and is less susceptible to being displaced by the oil and gas plume 20 as it is placed over the wellhead.

Housing 24 carries at least one propulsion and steering means 28. Means 28 preferably comprise biaxially movable, electrically driven propellers or hydraulically operated jets 30. Propellers or jets 30 receive their power, whether electrical or hydraulic, from cables or hoses 32, as the case may be, that form part of the cable and hose arrangement 14, which cables or hoses provide input to conventional electrical or hydraulic motors and actuators 34 that drive the propellers or jets 30 as well as control their biaxial positioning. According to a preferred embodiment, means 28 include at least one set of propellers or jets 30. More preferably, for optimum maneuverability and transport speed, a set of propellers or jets 30 is desirably provided at or near both the top and the bottom of the housing 24.

For clarity of illustration, cables or hoses 32 are shown exteriorly of housing 24. However, it will be understood that such cables or hoses may be situated interiorly of housing 24 for their protection during transport and operation of apparatus 12.

It is preferable that housing 24 be formed with a first shoulder 36 against which the trailing end of combined plug and valve device 26 may rest during transport of apparatus to a damaged wellhead. Such shoulder may be located anywhere along the length of housing 24 so long as it provides a stable seat for device 26 during transport. Housing 24 may also be provided with additional unnumbered shoulders for accommodating the upper edges/regions of the of the exposed structure of damaged wellhead 16. The bottom of housing 24 is open-bottomed and preferably outwardly flared or funnel-shaped as indicated at 38 to assist in placement of the housing over the wellhead 16. Additionally, although not illustrated, housing 24 also desirably carries a global positioning system transmitter and at least one video camera for coarse and fine positioning, respectively, of the housing 24 over the wellhead 16.

Figure 5:
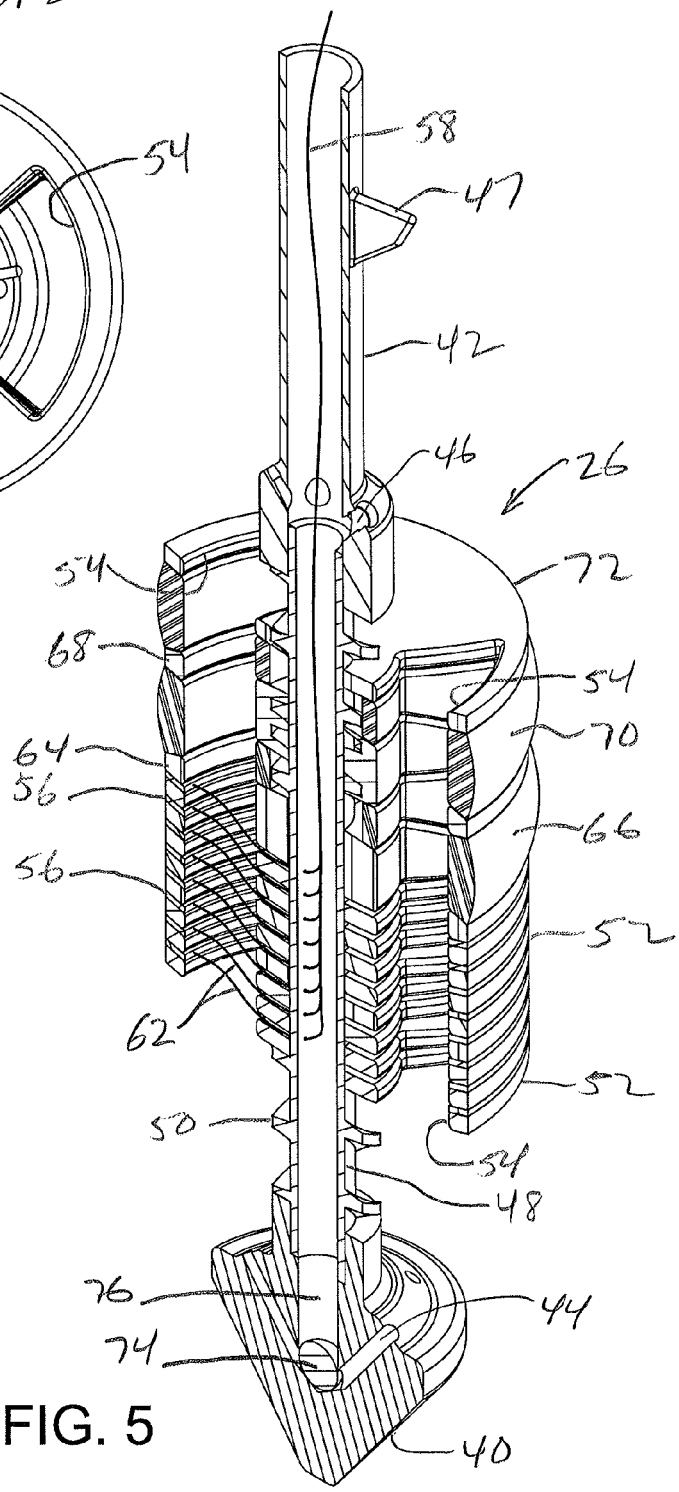
FIG. 5 is a perspective cross-section view of the device similar to FIG. 4.
Figure 7:
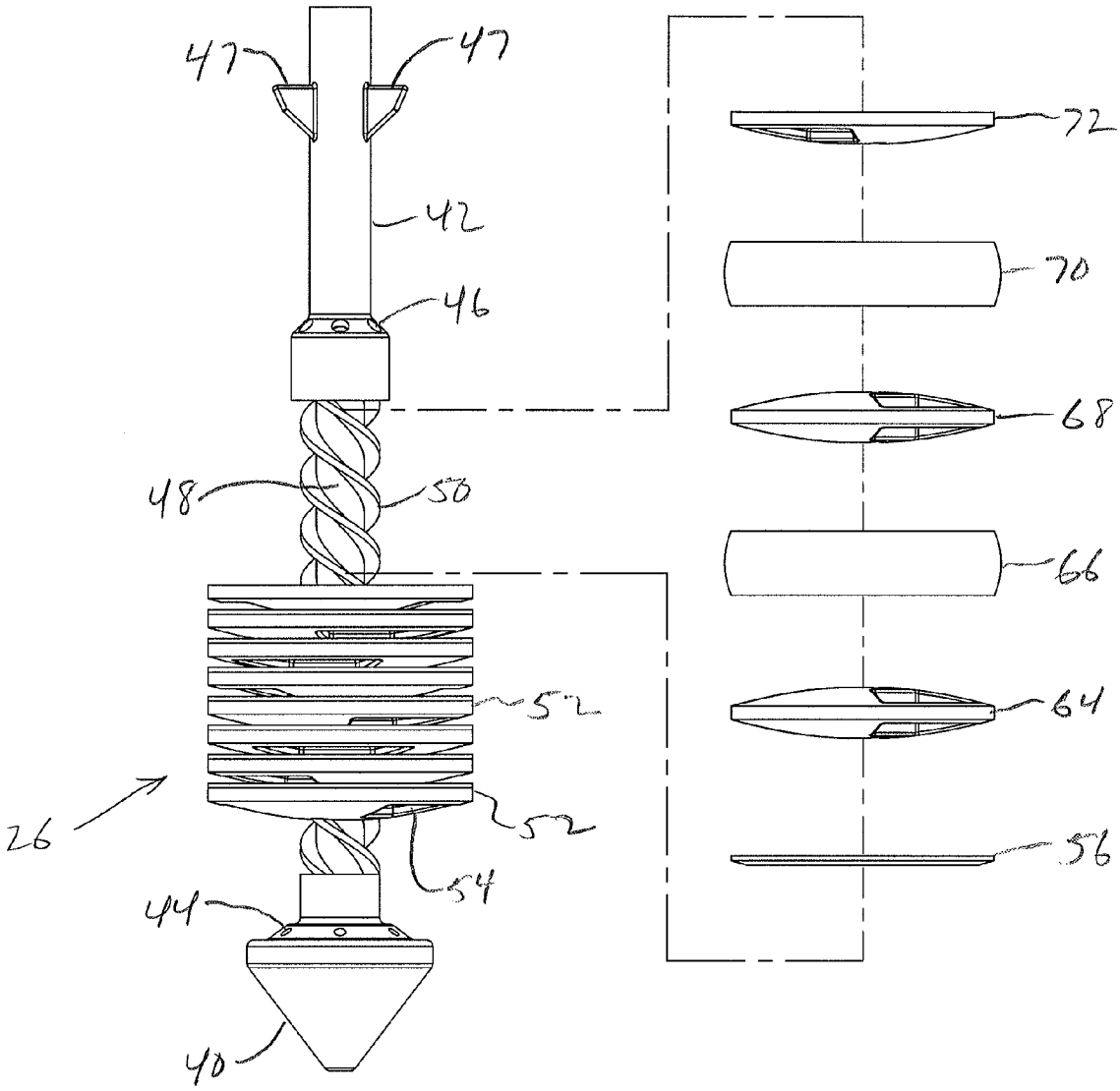
FIG. 7 is a partially exploded elevational view of the device.
Figure 8:
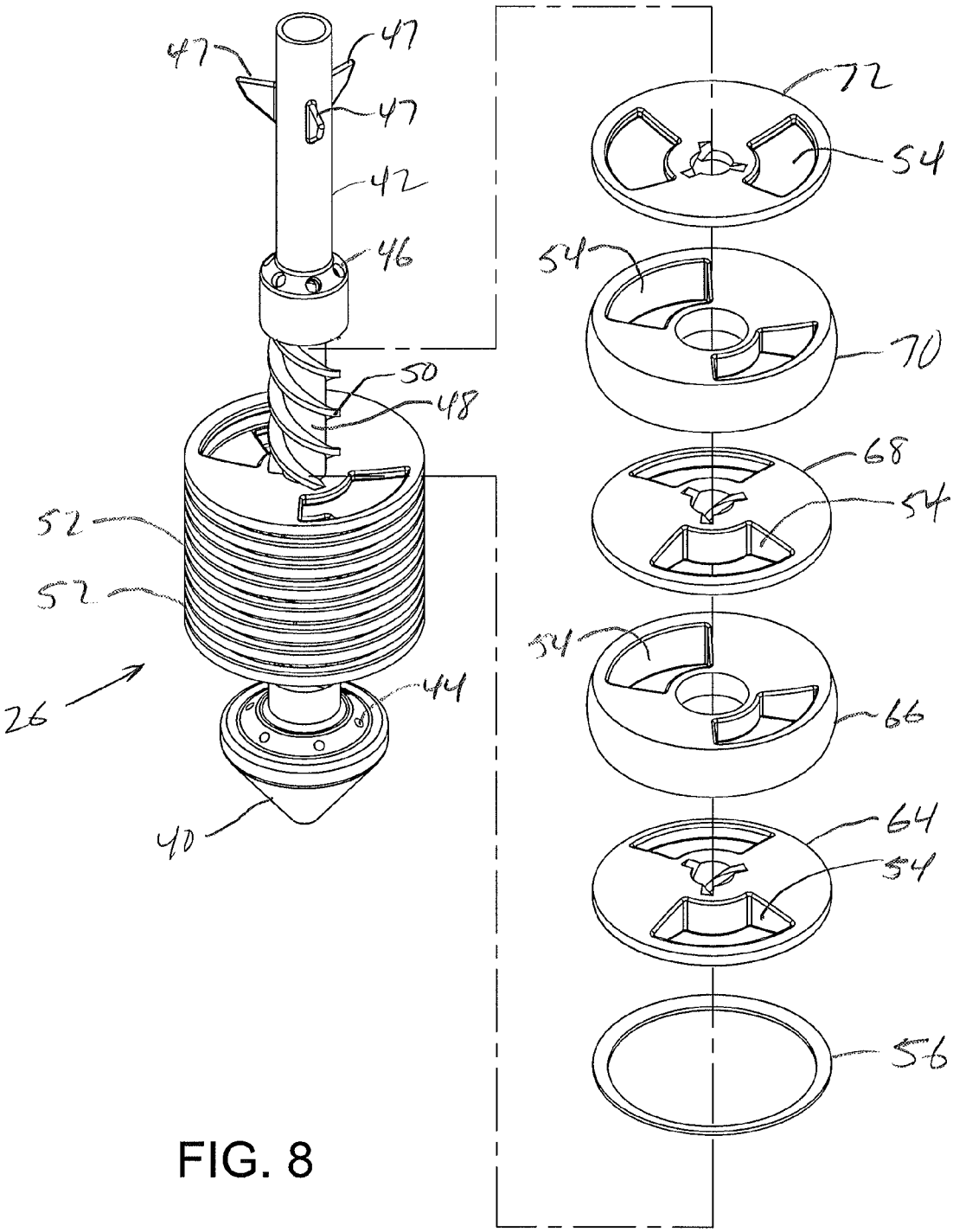
FIG. 8 is a partially exploded perspective view of the device.
Figure 9A:
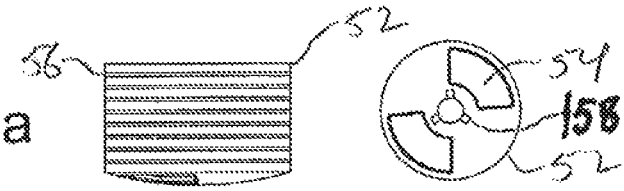
Figure 9B:
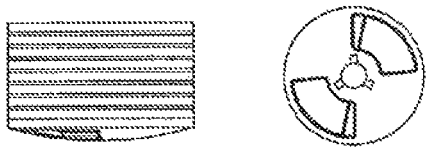
Figure 9C:
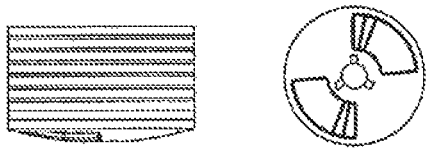
Figure 9E:
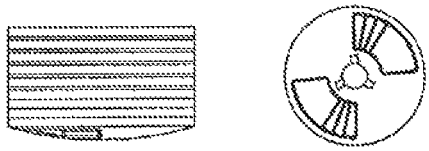
Figure 9F:
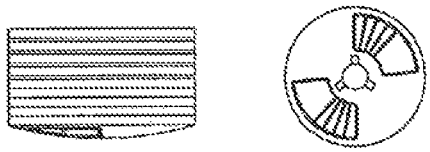
Figure 9G:
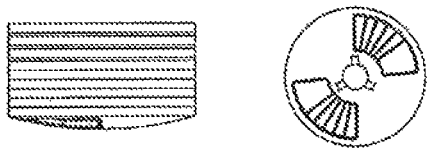
Figure 9H:
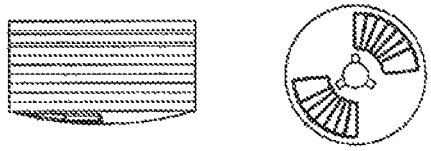
Figure 9I:
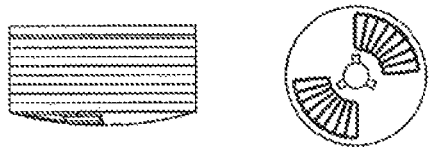
Figure 9J:
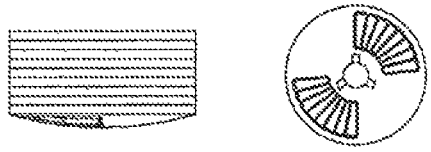
Figure 10:
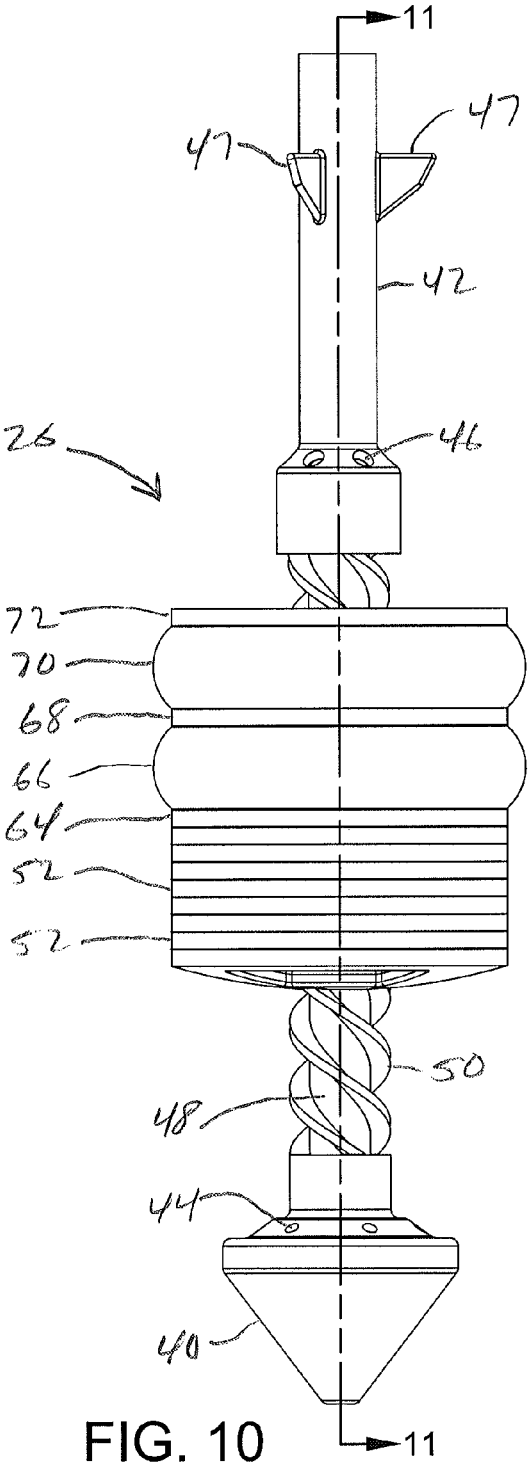
FIG. 10 is an elevational view of a first embodiment of a combined plug and valve device according to the invention in an anchored state.
Figure 11:
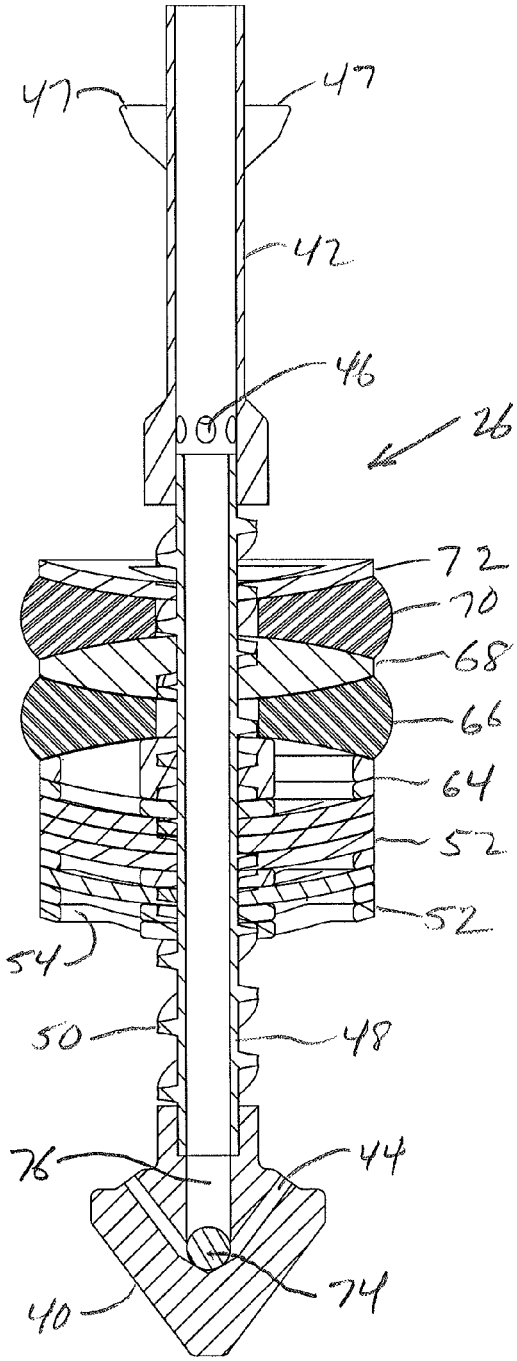
FIG. 11 is an elevational cross-section view of the device taken along line 11-11 of FIG. 10.
Figure 13:
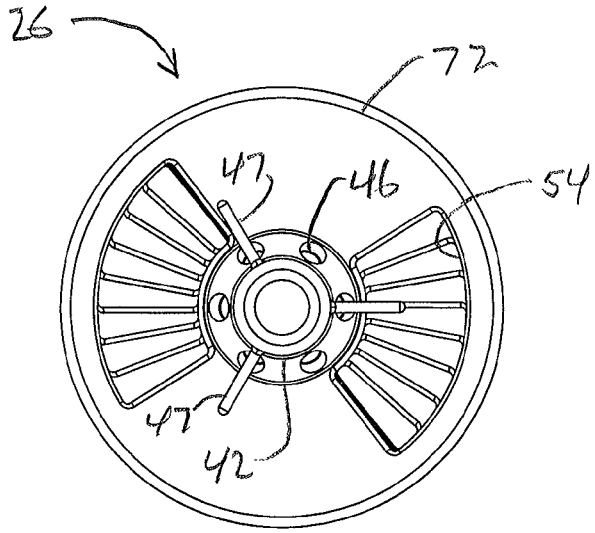
FIG. 13 is a top plan view of the device in a deployed state.
Figure 12:
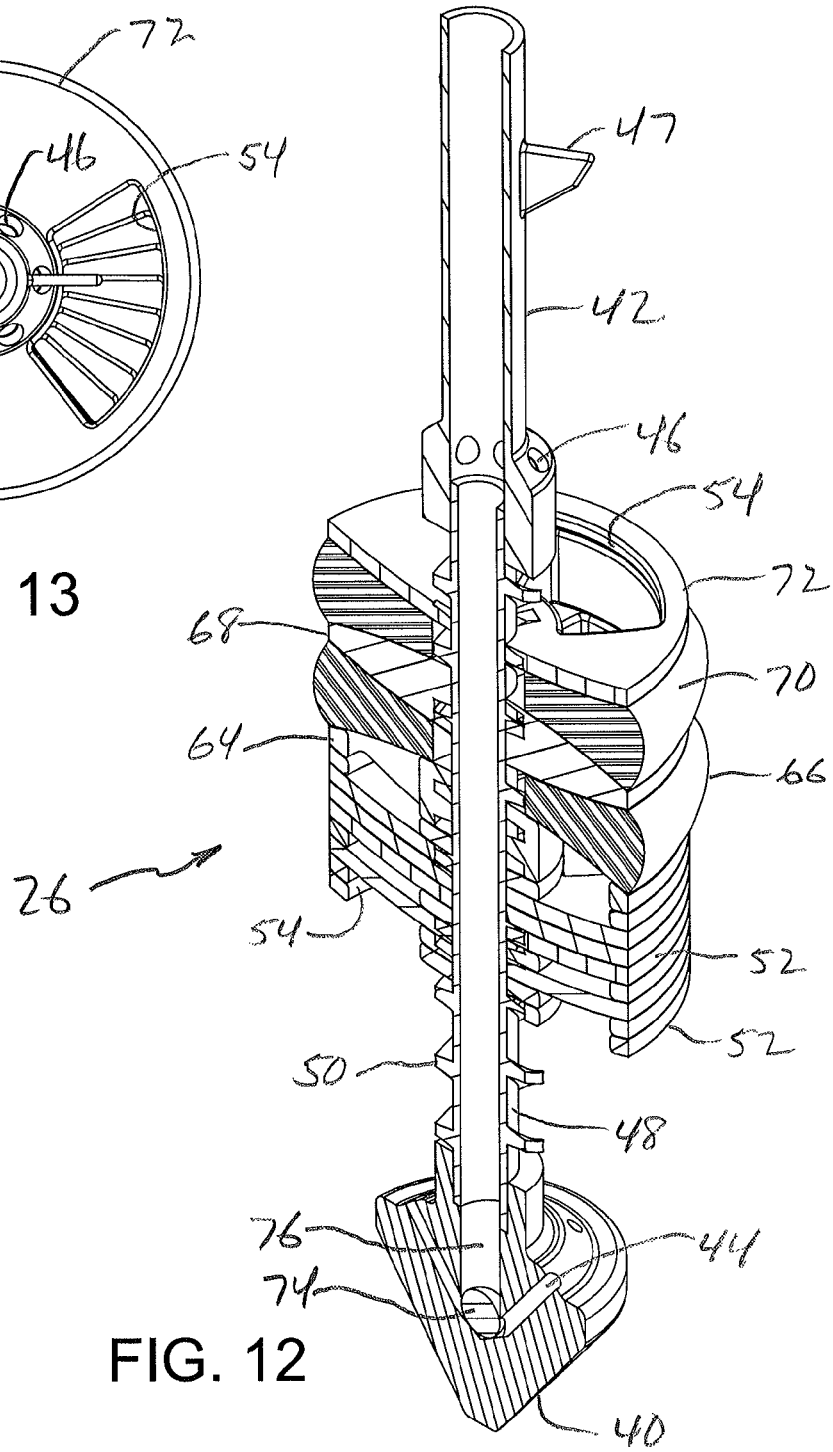
FIG. 12 is a perspective cross-section view of the device similar to FIG. 11.

FIGS. 3-8 illustrate on an enlarged scale a presently preferred construction of a combined plug and valve device according to the invention. Device 26 is preferably constructed with a hollow conical head portion 40 and a hollow tail portion 42, both having rearwardly directed jets or nozzles 44 and 46, respectively. The tail portion is preferably provided with a plurality of fins 47 for guiding the device 26 as it is propelled into a damaged well as described below. The head and tail portions may be securely connected to a hollow central tube 48 via mating threading, welding or other suitable attachment means. The hollow central tube 48 is provided with helical means 50 on and/or in its outer surface. Prior to attaching the head and tail portions 40, 42 to the central tube 48, a plurality of flat or curved leading plates 52, each having a central opening 158 (FIG. 9*a*) with threading corresponding to that of the helical means 50 of tube 48, are screwed onto the tube. Except where otherwise specified, components 40, 42, 48, 50 and 52 (and subsequently described elements 64, 68 and 72) of device 26 are desirably, although not necessarily, formed from metal such as, for example, steel, aluminum, copper, brass, or the like. As seen in FIG. 5, plates 52 are preferably slightly bowl-shaped in elevational cross-section so that the plates may flex slightly radially outwardly as they contact other plates in order to increase inter-plate friction and, therefore, reduce the likelihood of slippage between plates as they progress through the incremental flow channel closing process discussed below.

Each plate 52 includes at least one fluid passageway 54 through which seawater and well oil is initially intended to pass. The plates 52 are slightly smaller in diameter than the inside diameter of the well bore, pipe or tube to be plugged. In this connection, it will be understood that the entire system design, including the already-described components as well as those described below, is easily scalable to fit a well bore of any diameter to control natural gas and crude oil being discharged at any flow rate and pressure.

Leading plates 52 are separated by consumable spacer means 56, preferably an annular or ring-like spacer. A preferred spacer material is thermite which burns at predictable rates and is combustible under water. A further advantage of thermite is that it can be ignited simply by electrical resistance heating via application of a sufficiently high electrical current. It does not require a dedicated igniter mechanism which could be problematic in underwater environments. In this regard, FIG. 5 shows an electrical ignition cable 58 which may be carried by a pressurized fluid supply hose 60 (FIGS. 1 and 2) that leads from a launching rig or vessel to the apparatus 12. Situated within the ignition cable 58 are several ignition lines 62 each of which leads to a consumable spacer 56. As described in greater detail below, each ignition line 62 may be independently operated to selectively and progressively ignite the spacers 56.

Situated rearwardly of the rearmost spacer 56 is the final leading plate 64 that likewise has at least one fluid passageway 54. Plate 64 is preferably convex on both its forward and rearward surfaces. Following installation of plate 56, a first yieldable member 66 is placed over the tube 48. Like plates 52 and 64, anchor member 66 is provided with at least one fluid passageway 54. According to a preferred embodiment, yieldable member 66 is preferably constructed as a resilient or elastomeric disk-like element that both anchors device 26 to a well bore, tube or pipe, but also effectively seals the perimeter of the device against upwardly flowing well fluid.

Following placement of anchor member 66, a first threaded backing plate 68 is then installed. Like plate 64, plate 68 has at least one fluid passageway 54 and is preferably convex on both its forward and rearward surfaces. Following installation of plate 68, a second yieldable anchor member 70 having at least one fluid passageway 54 is placed over the tube 48. Following placement of anchor member 70, at least one other threaded backing plate 72 is screwed onto helical means 50 and preferably secured to tube 48 such as by welding or other suitable affixation means. Plate 72 has at least one fluid passageway 54 and may be generally similar in construction to any of plates 52, 64 and 68. However, it is preferred that the final backing plate be formed of especially high strength material and/or rigidified by gussets or the like in order to bear the full mass and momentum of the upwardly moving plates as well as the fluid pressure of the gushing well. In addition or in the alternative, additional backing plates may be added to tube 48 in order to bear the potentially tremendous upwardly directed forces exerted by the well fluid and the leading plates of the device itself.

Lastly, the head and tail portions 40, 42 are secured to central tube 48 to complete the assembly of the combined plug and valve device 26. Prior to deployment of device 26, however, the fluid passageways 54 of the several components are brought into alignment in the manner shown in FIGS. 3, 5 and 6 so as to establish one or more substantially unobstructed flow channels through which seawater may freely pass as apparatus 12 is lowered through the water and through which gushing crude oil and natural gas may pass as the apparatus is positioned over an uncontrolled well.

It will be appreciated that the combined plug and valve device 26 shown in FIGS. 3-8 is exemplary only and should not be construed as limiting. It is illustrative of but one version of myriad arrangements of plates and anchor members that may be suitable for plugging damaged undersea wellheads of any diameter and any fluid flow and/or pressure conditions. For instance, there may be as few as one or more than two anchor members depending on well size and conditions. Similarly, there may be more or less leading plates 52 and spacers 56 than as depicted in the drawing figures. Indeed, if well flow and pressure is modest, it is conceivable that as few as one anchor member, one backing plate, and as few as two leading plates 52 and a single spacer means 56 may be employed to effectively control well fluid flow and anchor the combined plug and valve device 26 to a bore, tube or pipe of a damaged well.

Following assembly of combined plug and valve device 26, the tail portion 42 thereof is desirably detachably connected to hose 60 such as by a releasable clamp or the like, either before or after device 26 is placed in housing 24. In this regard, housing 24 may be provided with an unillustrated access door or hatch on a side wall or top wall thereof in order to facilitate placement of the device 26 within the housing as well as to free tangled, kinked or snagged hoses and/or cables.

Referring again to FIG. 2, once housing 24 is stably positioned over wellhead 16 and the combined plug and valve device 26 is aligned with the well bore, pipe or tube to be plugged, water or other fluid is then pumped under pressure into hose 60. The pressurized fluid enters the combined plug and valve device 26 and is discharged through jets or nozzles 44, 46 whereby the device is propelled into the well against the pressure of upwardly flowing crude oil and natural gas. Upon insertion of the device to a desired depth within the damaged well bore or tubing such as shown in dashed line in FIG. 2, an optional dense stopper such as a ball-like stop 74 (FIGS. 4, 5, 11 and 12) may be inserted into the hose whereby it descends through the hose and into the plug and valve device whereupon it settles into a socket 76 at the head portion of device 26. With the stop 74 seated in the socket 76, fluid flow through the leading propulsion jets 44 is obstructed such that propulsion fluid flow is limited to the set of trailing jets 46. And, with propulsion flow limited to the rear jets, such flow may be relatively easily sustained at a level sufficient to counteract the flow of gushing crude oil and gas in order to maintain the combined plug and valve device in an essentially static position with respect to the well bore so that device 26 may be anchored or affixed to the interior wall of the well bore, tube or pipe.

Upon achieving the desired depth of insertion of the combined plug and valve device 26 into the well, the well shutoff and anchorage procedure can begin. As schematically represented in FIGS. 9*a*-9*j*, device 26 may be incrementally closed in order to affix the device to the damaged well and establish a desired degree of oil and gas flow through the device. That is, once the combined plug and valve device 26 is positioned in the well bore as described above, at least some of the plate passageways are brought into misalignment in order to restrict pressurized gas and oil flow through the passageways.

To achieve that effect, the consumable material above the forwardmost leading plate 52 is ignited and the space between the first plate and second plates is vacated. As this is occurring, pressure from the rising oil and gas pushes upward on the first plate, causing it to rotate and partially obstruct the flow channel established by the previously aligned plate flow passageways. Thereafter, the next consumable spacer is ignited and the first and second plates rotate upwardly as a unit until they contact the third plate. This procedure continues until the desired number of spacers have been consumed and the flow channels have been partially or completely blocked. Furthermore, as shown in FIGS. 10-13, as the mass of the stack of leading plates comes into contact with the forwardmost anchor member 66, the anchor members 66 and 70 become compressed between plates 64, 68 and 72 whereby they expand or bulge outwardly into contact with the inner wall of the surrounding well bore, tube or pipe.

By way of example, the uncontrolled Deepwater Horizon well was believed to have produced a gushing well plume with a highly powerful fluid pressure of some 6000 psi. Such high pressure would be more than sufficient to push several heavy steel plates upwardly along a helical path to achieve the objectives of the present invention. Furthermore, gradual or incremental closing of the combined plug and valve device 26 against such potentially destructive fluid force serves to prevent damage to the device during the process of constricting the well fluid flow while also enabling effective flow control should it be desired to preserve the well as a viable petroleum production site. As to the latter, by virtue of the present invention a previously uncontrolled well may be effectively converted into one producing less flow than in its original state but still constituting a manageable and commercially viable producer of crude oil.

Turning to FIGS. 10-13, the combined plug and valve device 26 is depicted as it would appear at the completion of step 9*j*. That is to say, all plate passageways 54 are in misalignment and the anchor members 66, 70 are in their expanded well-contacting state. So disposed, the device is fully closed wherein all well fluid flow is stopped and the well is effectively "killed".

At this point, hose 60 may be released from clamping engagement with the tail portion 42 of device by introducing a pulse of highly pressurized fluid through the hose, which pulse is not be readily dispersible through jets 46. As such, the sudden pulse or slug of fluid creates a burst of back pressure within the hose which is sufficient to dislodge the hose from clamping engagement with the device 26.

Figure 14:
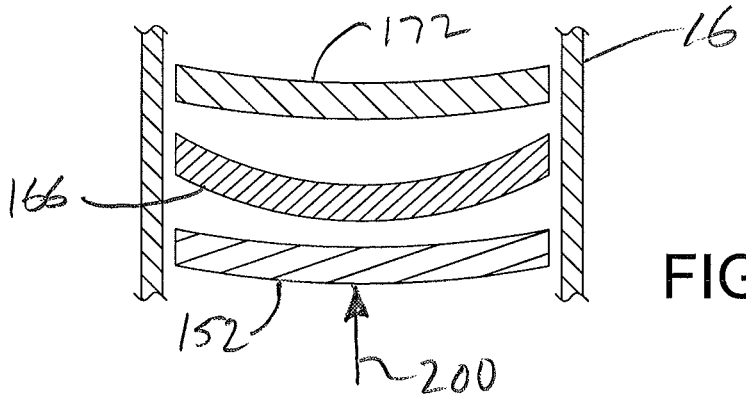
FIGS. 14-16 are elevational cross-section views showing sequential deployment of a second embodiment of a well plug according to the invention.
Figure 15:
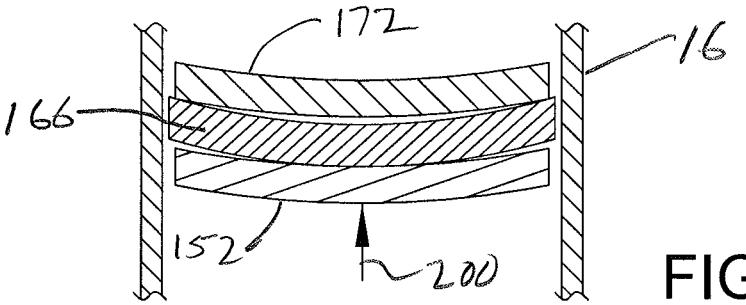
Figure 16:
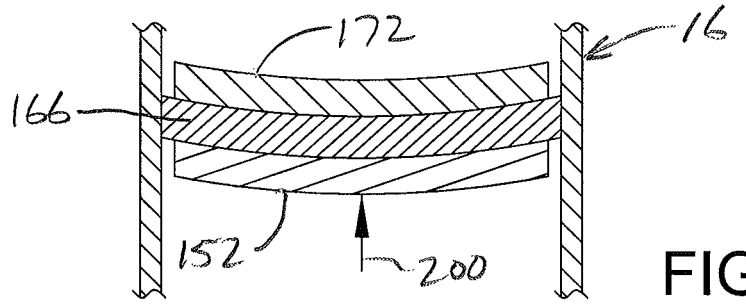

FIGS. 14-16 reveal an anchorage arrangement in accordance with an alternative embodiment of a combined plug and valve device according to the invention. For brevity, only those features that depart materially in structure and/or function from their counterparts in FIGS. 3-13 or are otherwise necessary for a proper understanding of the invention will be described in detail in connection with FIGS. 14-16.

FIGS. 14-16 schematically illustrate how an alternative anchor member 166 may be deployed to anchor, and preferably seal, a combined plug and valve device to the interior wall of a well bore, tube or pipe 16. As shown in those figures, a leading plate 152 and a backing plate 172 are positioned at opposite faces of an anchor member 166. According to this embodiment, anchor member is formed from yieldable metal, is generally bowl-shaped in cross-section, and has a radius of curvature less than backing plate 172. So constructed, as leading plate 152 moves upwardly against anchor member 166 in the direction of arrow 200 during a sequential passageway closure and anchorage procedure of the kind described above, anchor member 166 is compressed and flattened whereby its outer perimeter becomes radially enlarged. Indeed, the material, unstressed diameter and cross-sectional curvature of metal anchor member 166 are desirably selected such that, when the anchor member is properly compressed between leading and backing plates 152, 172, it desirably comes into tight compressive contact with and, most preferably, slightly embedded in the interior wall of the well bore, tube, or pipe 16 from which crude oil and natural gas is flowing. Once in contact with the well, plate 166 (or plates 166, if more than one such plate may be necessary to achieve desired anchoring and sealing) effectively anchors the combined plug and valve device and permits either no flow or some limited flow through the device as may be desired and as described above in connection with FIGS. 3-13.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. A well control device comprising:

a tube;

helical means provided on said tube;

a plurality of leading plates, each of said leading plates having at least one fluid passageway and helical means cooperable with said helical means of said tube to facilitate rotational movement of said leading plate about and axial movement of said leading plate along said tube;

consumable material disposed between said leading plates;

at least one backing plate carried by said tube and having at least one fluid passageway; and at least one yieldable anchor member having at least one fluid passageway, said anchor member being disposed between said at least one backing plate and one of said leading plates and operable to contact a well upon axial movement of said one of said leading plates along said tube in the direction of said backing plate, wherein, upon consumption of said consumable material, said leading plates are rotatably movable about said tube between positions in which the fluid passageways of said leading plates are substantially aligned with the fluid passageways of said backing plate and said yieldable anchor to establish at least one flow channel and positions in which the fluid passageways of said leading plates are misaligned with the fluid passageways of said backing plate and said yieldable anchor to limit fluid flow through said flow channel.

2. The device of claim 1 wherein said anchor member is operable to seal the device to a well upon axial movement of said one of said leading plates along said tube in the direction of said backing plate.

3. The device of claim 1 wherein said anchor member is formed of elastomeric material.

4. The device of claim 1 wherein said anchor member is formed of metal.

5. The device of claim 1 further comprising at least one set of jets in fluid communication with the interior of said tube whereby fluid flow through said tube and said at least one set of jets causes propulsion of the device into a well.

6. The device of claim 5 wherein said at least one set of jets comprises a first set of jets and a second set of jets.

7. The device of claim 6 further comprising a socket in communication with said first set of jets.

8. The device of claim 7 further comprising a stopper seatable in said socket for stopping fluid flow through said first set of jets.

9. A method for controlling a well comprising the steps of:

inserting the well control device of claim 1 into a well; and selectively misaligning the fluid passageways of said leading plates and the fluid passageways of said backing plate and said yieldable anchor to limit flow of well fluid therethrough.

10. The method of claim 9 further comprising the step of anchoring the well control device to the well.

11. A well control system comprising:

(a) a well control device comprising:

a tube;

helical means provided on said tube;

a plurality of leading plates, each of said leading plates having at least one fluid passageway and helical means cooperable with said helical means of said tube to facilitate rotational movement of said leading plate about and axial movement of said leading plate along said tube;

consumable material disposed between said leading plates;

at least one backing plate carried by said tube and having at least one fluid passageway; and at least one yieldable anchor member having at least one fluid passageway, said anchor member being disposed between said at least one backing plate and one of said leading plates and operable to contact a well upon axial movement of said one of said leading plates along said tube in the direction of said backing plate, wherein, upon consumption of said consumable material, said leading plates are rotatably movable about said tube between positions in which the fluid passageways of said leading plates are substantially aligned with the fluid passageways of said backing plate and said yieldable anchor to establish at least one flow channel and positions in which the fluid passageways of said leading plates are misaligned with the fluid passageways of said backing plate and said yieldable anchor to limit fluid flow through said flow channel; and (b) a housing surrounding said well control device.

12. The system of claim 11 wherein said housing is constructed as a cage.

13. The system of claim 11 wherein said housing has a shoulder for contacting said well control device.

14. The system of claim 11 wherein said housing has an open bottom.

15. A method for controlling a well comprising the steps of:

inserting a well control device having fluid passageways into a well;

wherein the well control device includes helical means and at least two plates carried by the helical means, wherein each plate has at least one fluid passageway and is separated from the other plate by consumable material, and selectively misaligning the fluid passageways to limit flow of well fluid therethrough wherein said selectively misaligning step comprises consuming said consumable material to permit relative rotation between the plates along said helical means under the influence of well fluid pressure.

* * * * *